US006193071B1

(12) United States Patent
Stelzer

(10) Patent No.: US 6,193,071 B1
(45) Date of Patent: Feb. 27, 2001

(54) MAGNETIC FORCE FIELD SEPARATOR

(76) Inventor: Ceil Stelzer, 606 S. Front St., Philadelphia, PA (US) 19147

( * ) Notice: Subject to any disclaimer, the term of this patent is extended or adjusted under 35 U.S.C. 154(b) by 0 days.

(21) Appl. No.: 09/229,102

(22) Filed: Jan. 11, 1999

Related U.S. Application Data

(62) Division of application No. 08/782,126, filed on Jan. 13, 1997.

(51) Int. Cl.[7] ..... B03C 1/00

(52) U.S. Cl. ..... 209/223.1; 209/231; 209/232; 209/213

(58) Field of Search ..... 210/222; 209/223.1, 209/224, 226, 227, 228, 231, 232, 213

(56) References Cited

U.S. PATENT DOCUMENTS

| | | | | |
|---|---|---|---|---|
| 2,792,115 | * | 5/1957 | Medearis | 209/223 |
| 3,676,337 | * | 7/1972 | Kolm | 210/42 |
| 4,261,815 | * | 4/1981 | Kelland | 209/213 |
| 4,668,383 | * | 5/1987 | Watson | 209/216 |
| 4,941,969 | * | 7/1990 | Schonert et al. | 209/39 |
| 5,169,006 | * | 12/1992 | Stelzer | 209/223.1 |
| 5,465,849 | * | 11/1995 | Wada et al. | 209/214 |
| 5,568,869 | * | 10/1996 | Turkenich et al. | 209/212 |
| 5,772,043 | * | 6/1998 | Saveliev | 209/212 |

FOREIGN PATENT DOCUMENTS

| | | | |
|---|---|---|---|
| 2444578 | * | 4/1976 | (DE) . |
| 2094183 | * | 9/1982 | (GB) . |

* cited by examiner

*Primary Examiner*—Donald P. Walsh
*Assistant Examiner*—David Jones

(57) ABSTRACT

A force field separator which utilizes magnetic fields to separate materials which are sensitive to those forces. As a magnetic separator it separates paramagnetic and diamagnetic materials with lower strength fields. It employs small sectional area rods which generate high field gradients between adjacent rods which are oriented at an angle to the flow direction inside an elongate housing which contains the fluid stream. The separation forces are a resultant of the force propelling the fluid through the housing and the field forces produced by the field gradients. The resultant force direction is towards multiple openings along the outside length of the housing where a separate plenum flow of separated materials is created.

5 Claims, 4 Drawing Sheets

FIG I

MAGNETIC FORCE FIELD SEPARATOR

This is a division of application Ser. No. 08/782,126 filed Jan. 13, 1997.

BACKGROUND OF THE INVENTION

1) Field of the Invention

The present invention relates to a separator which diverts selected components of a fluid stream out of the main stream using magnetic force fields.

2) Prior Art

Magnetic force fields can be created by electric currents and are known a magnetic fields. In magnetic separators, field gradients are produced which are changes in field strength with respect to position in the field volume. Magnetic field gradients produce forces on molecules or particles which have a non zero magnetic susceptibility.

Previously patented separators using magnetic fields such as magnetic separators use a high strength magnetic field to produce magnetic gradients in the fluid flow. Magnetic materials in the fluid interact with the magnetic gradients because of the magnetic forces between them.

The intermittent type of magnetic separators such as the Kolm type, see U.S. Pat. No. 3,676,337, have the magnetic gradients randomly distributed throughout the volume of fluid flow and rely on the magnetic forces to embed the magnetic materials in the magnetic gradient areas. They must be turned off and periodically flushed to clean the magnetic materials away.

To overcome the requirement of periodically flushing, several continuous magnetic separators have been proposed.

Kelland in U.S. Pat. No. 4,261,815, discloses a separator apparatus in which a grid of fine ferromagnetic wires are arranged parallel to the flow of the fluid to be separated and a strong magnetic field is produced perpendicular to the wires and flow. The wires distort the magnetic field and result in a magnetic gradient around the wires which concentrates magnetic materials on opposite sides along each wires axis. As the wires near the end of the magnetic field there is a grid matrix for separation of the flows from each wire. This results in the need for small openings for each wire, which can become clogged and are difficult to fabricate.

In U.S. Pat. No. 5,169,006 I previously patented a continuous magnetic separator which employs rods comprised of alternating sections of nonmagnetic and ferromagnetic materials. This invention is an improvement on that patent because this invention is more efficient because the field gradients are continuous across the separation region.

SUMMARY OF THE INVENTION

An object of the present invention is to provide a new and improved magnetic separator much smaller in size and less expensive in cost.

A further object of the present invention is to provide a new and improved magnetic separator to more efficiently separate materials of different magnetic susceptibilities over a wider range of susceptibilities and particle sizes.

A further object of the present invention is to provide separation of molecules from a fluid stream with lower energy expenditure.

These and still further objects are discussed hereinafter and are particularly delineated in the appended claims.

The foregoing objects are achieved in a force field separator which receives a fluid stream or slurry containing materials which will be subjected to a force when they enter the 3 dimensional array of field gradients inside the separator. The fluid stream is propelled axially through the separator in the initial flow direction. The array of field gradients is produced by a repetitive pattern of rods arranged at an angle between parallel and perpendicular to the initial flow direction into the separator. Those materials will move toward the outside walls of the separator because of the resultant force on them due to the combination of the force propelling them axially through the separator and the force fields set up inside the separator. The separator includes an elongate outer housing that receives the fluid, which flows axially through the housing and means for providing a field between a plurality of small diameter wires or rods disposed within the housing and oriented at a given angle between parallel and perpendicular to the direction of flow of the fluid stream. The given angle is designed based on the relative magnitude of the force propelling the fluid stream axially through the separator and the forces on the selected materials due to the field gradients between the plurality of small diameter rods. The combination of those forces and the angle of the rods produces resultant forces on those select molecules or particles sensitive to the field gradients, which are different in relation to the particle or molecules location relative to the rods. When the field gradient force has a component opposite in direction to the propelling force, the resultant force moves the particle towards the outside wall, and also within a channel parallel to the rods, because the angle of the rods is the same as the angle of the resultant force. These particles tend to maintain the same relation relative to the rods, and remain in the channel moving towards the outside wall. When the field gradient force has a component in the same direction as the propelling force, the resultant force moves the particle to a location where the field gradient has a component opposite in direction to the propelling force or the first case. Thus, the select molecules or particles will concentrate in the channels parallel to the rods where the resultant force is towards the outside wall. At the outside walls, partitions or slits to an cuter plenum are located to divert the flow into separate plenum streams, where the select molecules or particles are removed from the main fluid stream.

BRIEF DESCRIPTION OF THE DRAWINGS

A preferred embodiment of the invention is hereinafter described with reference to the accompanying drawings in which.

DETAILED DESCRIPTION

This is a force field separator which uses the combination of the force propelling a fluid stream through an elongate outer housing and field forces produced by parallel rods or wires to move those select materials in the fluid stream which are influenced by the field forces, across the fluid stream in a general direction parallel to the rods. If the select materials in the fluid stream to be separated have a difference in magnetic susceptibility compared to the fluid stream, then they will be influenced by magnetic field forces.

There is an elongate outer housing to contain the fluid stream which contains the select materials which are influenced by the magnetic field forces.

Means are provided to separate the fluid stream into separate plenum flows having higher concentration of the select materials along the length of the elongate outer housing, through multiple openings in the outer side walls of the elongate outer housing.

There is a plurality of small cross sectional area parallel rods originating and terminating near opposite side walls of the elongate outer housing, oriented at an angle between parallel and perpendicular to the direction of the force propelling the fluid stream through the separator. The rods produce field forces which are magnetic between adjacent rods, and that are perpendicular to the rods.

Means for creating magnetic force gradients between adjacent ferromagnetic rods can be provided by an external magnetic field with the field direction parallel to the fluid flow direction by a solenoidal coil of electric current around the outside perimeter of the elongate outer housing. There can also be a combination of both magnetic and electric field forces by creating electric field force gradients between rods of different voltage potentials while simultaneously providing means to generate a magnetic field which penetrates the elongate outer housing and is perpendicular to the fluid flow direction.

Figure 1:
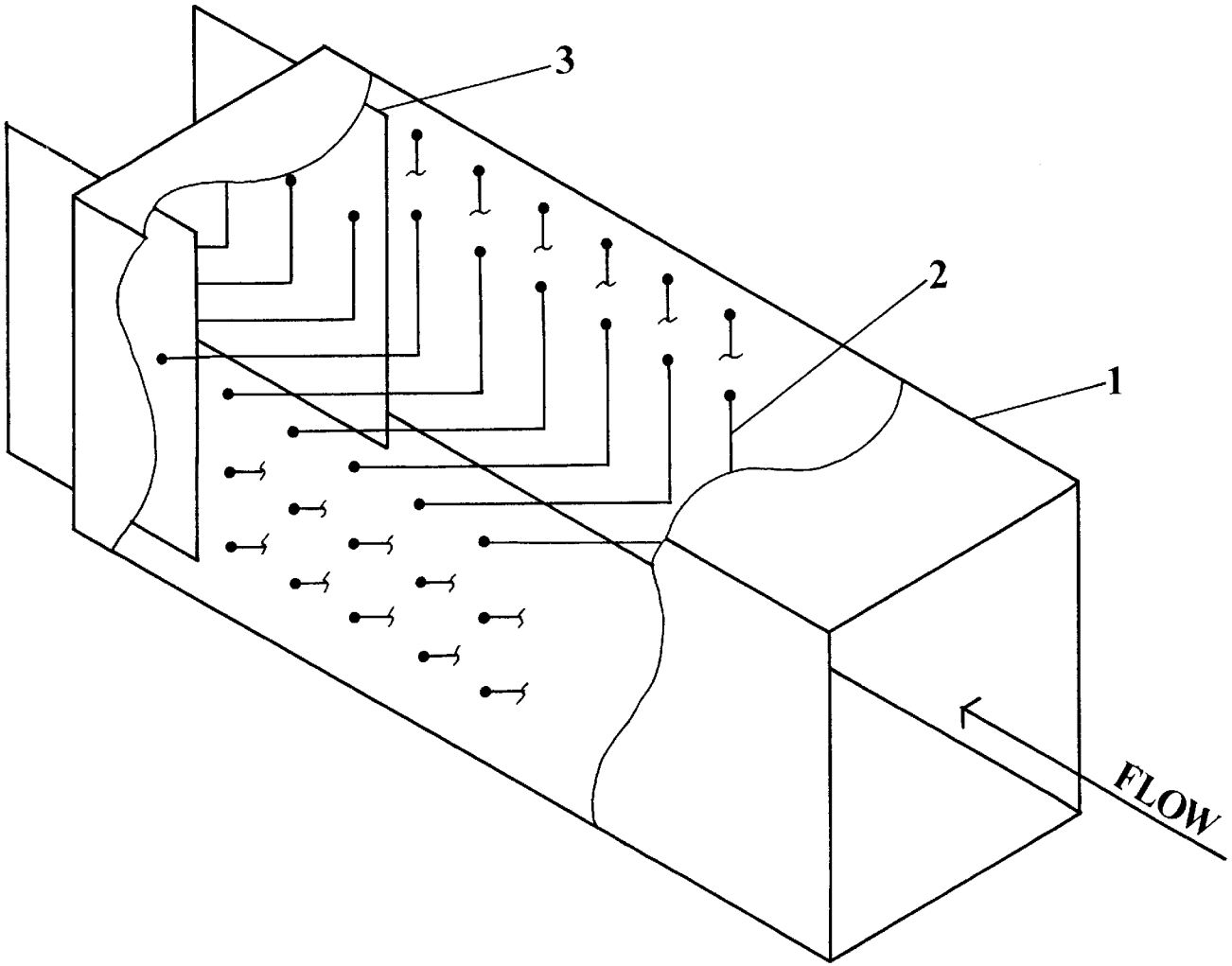
FIG. 1 is an isometric view of the elongate outer housing, partially cut away, showing some of the rods which are at an angle of 45 degrees to the direction of flow. The complete volume inside the separator contains rods. Not shown is the rod support in the center where the rods change direction.

Referring to FIG. 1, the fluid stream flows in the direction shown into the elongate housing 1 and into the array of rods 2, which are at an angle of 45 degrees away from the center line and toward the outside walls of the housing. The most effective angles of the rods to the direction of the force propelling the fluid stream through the separator are between 20 to 70 degrees. The entire volume inside the separator contains the array of rods 2, to allow the maximum number of channels, a series of which are shown in FIG. 2 in the plan view.

Figure 2:
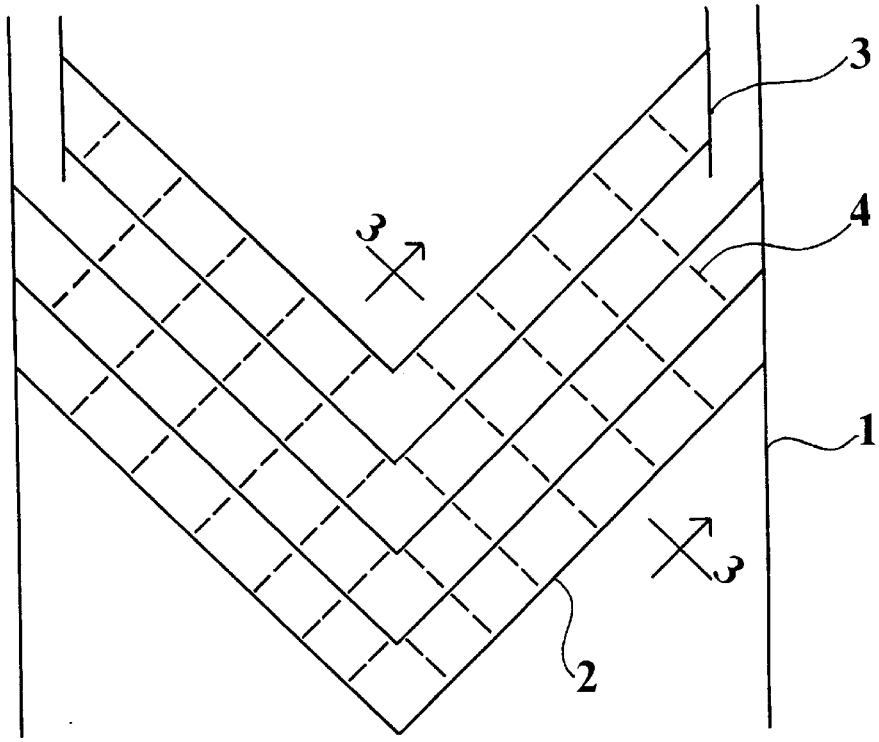
FIG. 2 is a plan view of FIG. 1 showing one row of rods.
Figure 3:
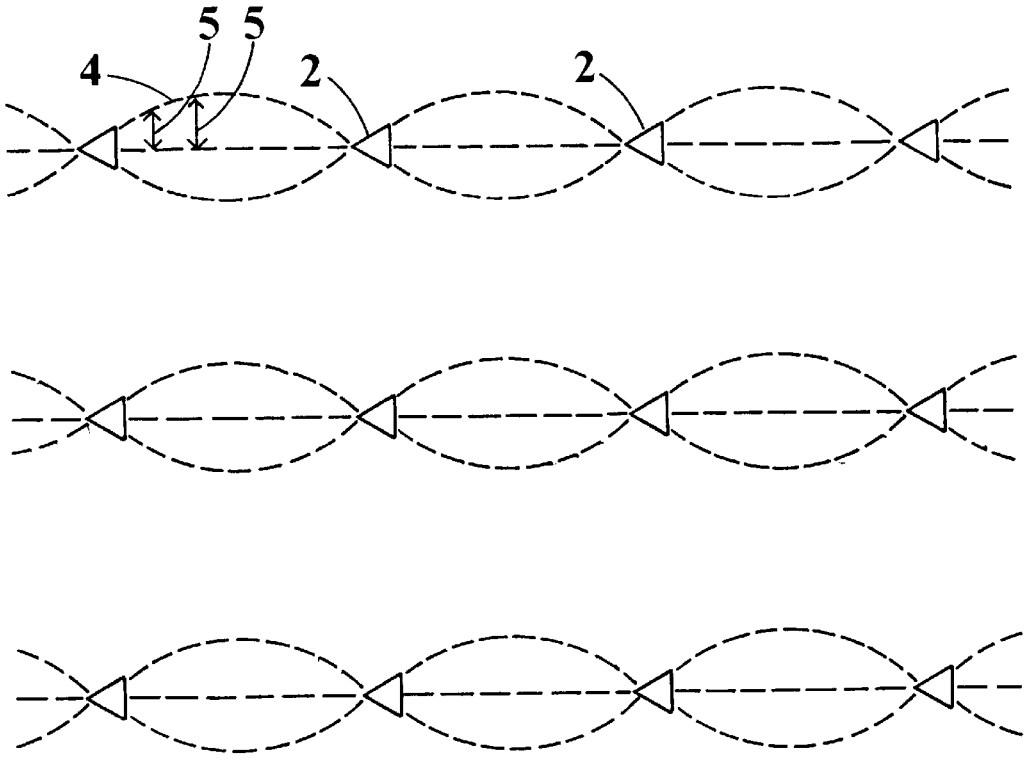
FIG. 3 is a section view of a portion of FIG. 2.

In FIG. 2, the fields 4, shown as dashed lines, pass between the rods in a direction which is normal to the direction of the rods. The rods are ferromagnetic in the case of an external magnetic field. As the field leaves and enters each rod, gradients or differences in field line spacing, are produced, which are shown as 5 in FIG. 3, which is the section view of FIG. 2.

Figure 4:
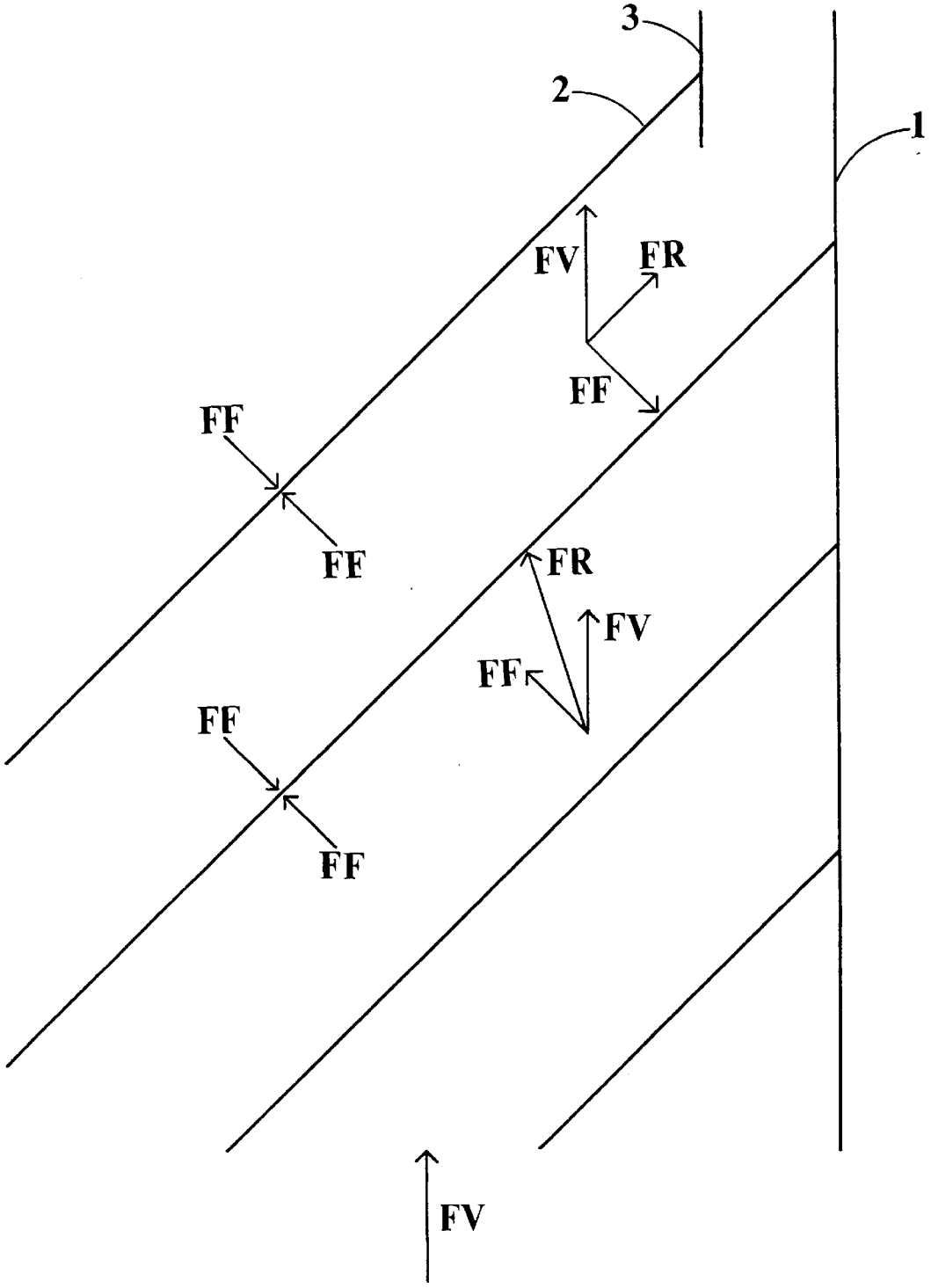
FIG. 4 is an enlargement of a portion of the plan view of FIG. 2.
Figure 5:
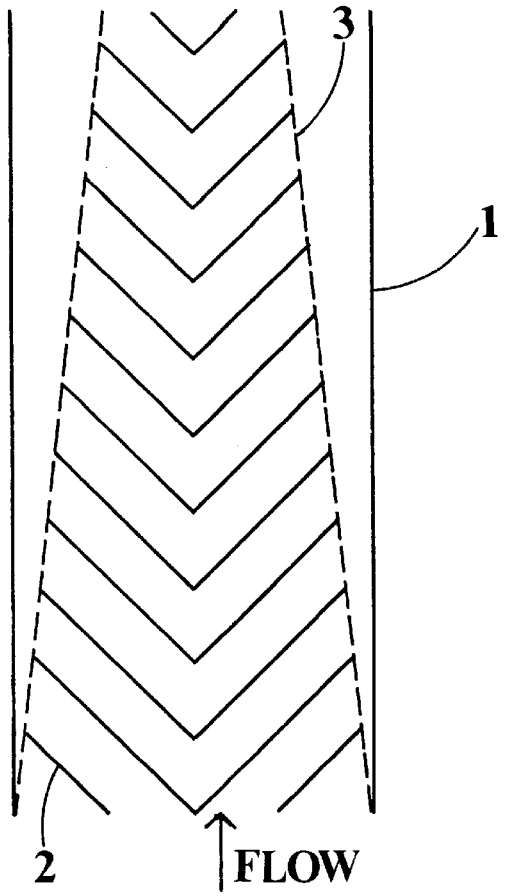
FIG. 5 is a plan view of the elongate housing showing some rods.
Figure 6:
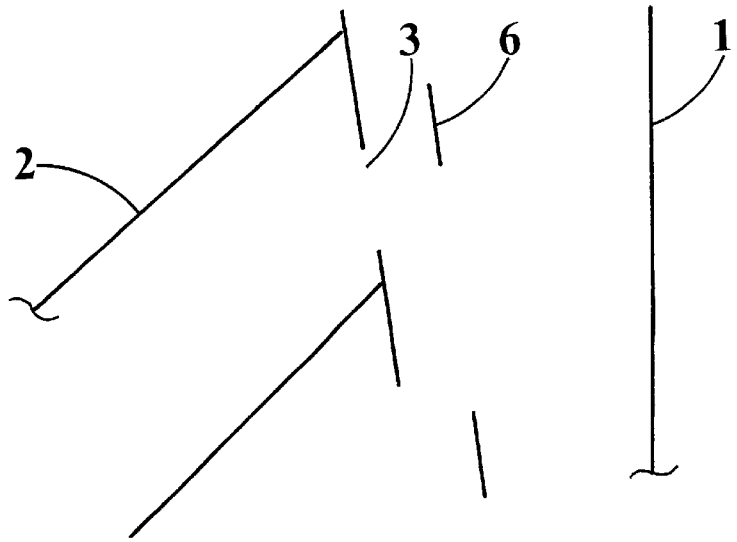
FIG. 6 is an enlargement of a portion of the plan view of FIG. 5 showing additional details.

The field gradient forces on the select materials will be in the same direction as the field lines and will also be normal to the direction of the rods and are shown as field force FF in FIG. 4, which is an enlargement of the rods in FIG. 2. The field force vector FF is either towards a rod, or away from a rod, depending upon the select materials positive or negative magnetic susceptibility. In FIG. 4 positive magnetic susceptibility is assumed. For negative magnetic susceptibility the field forces would be in the opposite direction than those shown. The spaces between rods form channels which alternate in the field force vectors direction. The force of fluid velocity through the housing is shown as vector FV in FIG. 4 and is in the direction of the fluid stream flow as the fluid enters the housing. When the fluid enters the force field channels, the resultant force on the select materials will be a combination of FF and FV. Materials in the fluid flow which are not sensitive to the force fields will move through the housing in their original flow direction. Select materials, which are sensitive to the force fields will experience a changing resultant force, depending upon which channel they are in. The resultant force vector FR in FIG. 4, is shown for the 2 different channels, in the plan view. In one case, the resultant force is in the same direction as the rods and towards the outside wall of the housing. Select materials in this channel will tend to stay in this channel and move to the outside wall. Select materials in the other channel will be subject to a resultant force which will tend to move them out of that channel and into the other type of channel. Thus, the select materials will concentrate in the channels which move them towards the outside wall and produce a high concentration at the outside walls where separate baffles or slits ,3, in the outside wall, as shown in FIG. 5, allow the concentrated select materials to flow into a separate plenum, which may be under a suction pressure to aid the flow of select materials. The output of the separate plenum can be cascaded into succeeding force field separators to produce increasing concentrations of select materials. Additional electrically conducting rods or plates ,6, may be located near the multiple openings in the outer side walls of the elongate housing as shown in FIG. 6, which is an enlargement of a portion of FIG. 5. Those additional plates will help to draw the select materials into the outside plenum when the plates have the proper voltage potential on them.

The rods can be of different cross sectional areas in a repetitive pattern to allow the production of high magnetic field gradients.

The high magnetic field gradients can be produced by rods made of materials which distort a magnetic field produced outside the housing and which enters through the walls of the housing.

The rod cross sections can be of any shape, and may be mounted on a flat substrate or foundation which is comprised of materials which have little or no effect on the force field gradients. The substrate would allow fabrication of very small rod sizes with very close spacing. The flat substrates would be stacked to form a 3 dimensional pattern of rods, with the fluid stream flowing between parallel plates. When the rods are in a cross sectional shape of a wedge or triangle or similar shape and are oriented with the wider side of the shape perpendicular to the field direction, then the shape tends to concentrate or amplify the field lines into high gradients as the field lines emerge from the opposite side of the shape which is not as wide. This is because the field lines can move more easily through the shape than the medium surrounding it when the rods are ferromagnetic.

The array of field gradients can be arranged as a mirror image of each side to the center of the separator. Each side along the length of the separator is a mirror image of the opposite side so that select materials move from the center towards opposite outside walls.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A magnetic force field separator for separating select materials of a fluid stream out of a main stream, which uses the combination of a force propelling a fluid stream through an elongate outer housing and magnetic field forces produced by parallel triangular cross sectionally shaped to move select materials in the fluid stream which are influenced by said magnetic field forces, across the fluid stream in a general direction parallel to the rods, the separator comprising:

an elongate outer housing, having outer side walls, to contain said fluid stream containing said select materials which are influenced by said magnetic field forces, means to propel said fluid stream axially through said elongate outer housing, means to separate said fluid stream into separate plenum flows having higher concentration of said select materials along the length of said elongate outer housing, through multiple openings in said outer side walls of said elongate outer housing, a plurality of triangular cross sectionally shaped, ferromagnetic, parallel rods originating and terminating near opposite side walls of said elongate outer housing, oriented at an angle between parallel and perpendicular to the direction of said force propelling said fluid stream through the separator, said rods producing said magnetic field forces between adjacent said rods, whereby said magnetic field forces are perpendicular to said rods, and means for creating said magnetic field forces between said rods.

2. A magnetic force field separator as claimed in 1) wherein each side along a center line down the length of the separator is a mirror image of the opposite side so said select materials move from the center line towards opposite outside walls of said elongate outer housing.

3. A magnetic force field separator as claimed in 1) wherein said rods are at an angle between 20 degrees and 70 degrees to the direction of said force propelling said fluid stream through the separator.

4. A magnetic force field separator as claimed in 1) wherein said rods are in a cross sectional shape of a wedge.

5. A magnetic force field separator as claimed in 1) wherein the ferromagnetic rods are mounted on a flat substrate comprised of nonferromagnetic materials.

* * * * *